US008881800B2

(12) United States Patent
Diehl

(10) Patent No.: US 8,881,800 B2
(45) Date of Patent: Nov. 11, 2014

(54) INSTALLATION FOR THE IN SITU EXTRACTION OF A SUBSTANCE CONTAINING CARBON

(75) Inventor: Dirk Diehl, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 723 days.

(21) Appl. No.: 13/060,816

(22) PCT Filed: Jul. 19, 2009

(86) PCT No.: PCT/EP2009/059168

§ 371 (c)(1),
(2), (4) Date: Feb. 25, 2011

(87) PCT Pub. No.: WO2010/023032

PCT Pub. Date: Mar. 4, 2010

(65) Prior Publication Data

US 2011/0146968 A1 Jun. 23, 2011

(30) Foreign Application Priority Data

Aug. 29, 2008 (DE) ..... 10 2008 044 953

(51) Int. Cl.

| | |
|---|---|
| ***E21B 36/04*** | (2006.01) |
| ***H05B 6/62*** | (2006.01) |
| ***E21B 43/30*** | (2006.01) |
| ***E21B 43/24*** | (2006.01) |

(52) U.S. Cl.

CPC ..... *E21B 43/2401* (2013.01); *H05B 6/62* (2013.01); *E21B 43/305* (2013.01); *H05B 2214/03* (2013.01)

USPC ..... 166/60; 166/302; 166/245; 166/65.1

(58) Field of Classification Search

USPC ..... 166/60, 302, 245, 248, 65.1

See application file for complete search history.

(56) References Cited

U.S. PATENT DOCUMENTS

| | | | |
|---|---|---|---|
| 4,116,273 | A | 9/1978 | Fisher et al. |
| 4,144,935 | A | 3/1979 | Bridges et al. |
| 2006/0021752 | A1 | 2/2006 | De St Remey |

FOREIGN PATENT DOCUMENTS

| | | | |
|---|---|---|---|
| DE | 2636530 | A1 | 5/1978 |
| DE | 102007008292 | A1 | 8/2008 |
| DE | 102007040605 | B3 | 10/2008 |
| DE | 102007040607 | B3 | 10/2008 |
| DE | 102007036832 | A1 | 2/2009 |
| DE | 102008012895 | A1 | 9/2009 |

*Primary Examiner* — David Andrews
*Assistant Examiner* — Taras P Bemko

(57) ABSTRACT

An installation for the in-situ extraction of a substance including hydrocarbons from an underground deposit is provided. The conductor and return conductor of the inductor lines are guided essentially vertically in the capping to the bottom of the deposit, at a small maximum lateral distance of 10 m compared to the length of the lines, but especially less than 5 m. Preferably, the inductor lines are guided horizontally in the deposit and are at different distances in certain areas. Furthermore, the electrical conductors and return conductors perpendicularly extending in the capping preferably combine to form a conductor pair. In this way, the conductor pair can be introduced into a single borehole which reaches into the reservoir and splits only once it has arrived in the reservoir.

17 Claims, 5 Drawing Sheets

INSTALLATION FOR THE IN SITU EXTRACTION OF A SUBSTANCE CONTAINING CARBON

CROSS REFERENCE TO RELATED APPLICATIONS

This application is the US National Stage of International Application No. PCT/EP2009/059168, filed Jul. 16, 2009 and claims the benefit thereof. The International Application claims the benefits of German application No. 10 2008 044 953.9 DE filed Aug. 29, 2008. All of the applications are incorporated by reference herein in their entirety.

FIELD OF INVENTION

The invention relates to an installation for the in-situ extraction of a carbonaceous substance from an underground deposit while reducing the viscosity thereof. Such an apparatus is used in particular for extracting bitumen or extra-heavy oil from a reservoir under a capping, such as that found in incidences of oil shale and/or oil sand in Canada, for example.

BACKGROUND OF INVENTION

In order to extract extra-heavy oils or bitumen from the known incidences of oil sand or oil shale, their flowability must be significantly increased. This can be achieved by increasing the temperature of the incidence (reservoir). If inductive heating is used for this purpose, the problem arises that the electrical forward and return conductors, which feed the inductors that have been introduced into the reservoir, also unintentionally heat the capping. The heat output transferred to the capping represents a loss in terms of the reservoir heating costs, and this loss should be avoided.

The increase in flowability can be achieved either by introducing solvents or thinners and/or by heating or fusion of the extra-heavy oil or bitumen, for which purpose heating is effected by means of pipe systems that are introduced through bore holes.

The most widespread and commonly used in-situ method for extracting bitumen or extra-heavy oil is the SAGD (Steam Assisted Gravity Drainage) method. In this case, steam (to which solvents may be added) is forced under high pressure through a pipe which runs horizontally within the layer. The heated fused bitumen or extra-heavy oil, once separated from the sand or rock, seeps down to a second pipe which is laid approximately 5 m deeper and via which the extraction of the liquefied bitumen or extra-heavy oil takes place, wherein the distance between injector and production pipe is dependent on the reservoir geometry.

The steam has to perform several tasks concurrently in this case, specifically the introduction of heat energy for the liquefaction, the separation from the sand, and the build-up of pressure in the reservoir, in order firstly to render the reservoir geo-mechanically permeable for bitumen transport (permeability), and secondly to allow the extraction of the bitumen without additional pumps.

The SAGD method starts by introducing steam through both pipes for typically three months, in order first to liquefy the bitumen in the space between the pipes as quickly as possible. This is followed by the introduction of steam through the upper pipe only, and the extraction through the lower pipe can commence.

The German patent application DE 10 2007 008 292 with earlier priority already specifies that the SAGD method normally used for this purpose can be completed using an inductive heating apparatus. Furthermore, the German patent application DE 10 2007 036 832 with earlier priority describes an apparatus in which provision is made for arrangements of inductors or electrodes running in parallel as per FIG. 5, said arrangements being connected above ground to the oscillator or converter.

The earlier, German patent applications DE 10 2007 008 292 and DE 10 2007 036 832 therefore propose inductive heating of the deposit in addition to the introduction of steam. If applicable, resistive heating between two electrodes can also be effected in this case.

In the installations described above, the electrical energy must always be carried via an electrical forward conductor and an electrical return conductor. This involves considerable expense.

In the earlier patent applications, individual inductor pairs comprising forward and return conductors, or groups of inductor pairs in various geometric configurations, are exposed to current in order to heat the reservoir inductively. In this case, a constant distance between the inductors is assumed within the reservoir, resulting in a constant heat output along the inductors in the case of homogenous electrical conductivity distribution. In the description, the forward and return conductors are guided in close spatial proximity in the sections in which the capping (overburden) is breached, in order to minimize the losses there.

As described in the earlier, non-prior published applications, variation of the heat output along the inductors can be effected specifically by sectional injection of electrolytes, thereby changing the impedance. This requires corresponding electrolyte injection apparatus, which must be integrated at considerable expense in the inductors or requires additional costly boreholes.

SUMMARY OF INVENTION

With this as its starting point, the object of the invention is to optimize the above-described installation for inductive heating, and simplify said installation in terms of energy input. It is also intended to minimize the power consumption itself.

The object is achieved according to the invention by the sum of the features in the claims. Developments are specified in the subclaims.

The subject matter of the invention is an induction-heated installation, in which the forward and return conductors for the inductor lines are guided in an essentially vertical manner and have a limited lateral distance between them of no more than 10 m. However, the distance is preferably less than 5 m. To this end, parallel boreholes at this distance can be provided in the capping structure, such that return conductors are guided separately for this purpose. It is advantageously possible to start from a single borehole, in which forward and return conductors are guided together. This has the advantage that practically no electrical power is lost in the vertically guided region, as the electromagnetic effects are compensated as a result of the conductors being guided closely together.

According to the invention, forward and return conductors of the induction conductors can therefore be separate lines which are guided laterally alongside each other. They can also be designed as lines that are stranded together, and also as coaxial lines in particular. In particular, such coaxial lines can be guided in a correspondingly adapted borehole.

Using the latter construction in particular, a branch point (so-called Y junction) is provided at the end of the combined lines. The inductor lines which depart therefrom and are guided horizontally can run in the same direction, but can also run in opposing directions.

In an inventive development, the inductor lines running horizontally in the deposit can be separated by regionally varying distances. In particular, this can prevent losses by guiding the lines closely in parallel again in regions where no inductive heating is required and/or desired, such that no unnecessary heat output is expended.

The invention offers all manner of feature combinations or possibilities for inventive development. The essential developments are listed individually below:

1. The forward and return conductors which run vertically and are combined to form a line pair can advantageously be introduced into a single borehole (as mentioned above), which extends downwards into the reservoir, and only split (Y junction) once they are in the reservoir. In this case, the forward/return conductor pair can be of stranded or coaxial design and can be insulated individually or together (combined insulation). The use of a single borehole extending down into the reservoir is also possible for a plurality of forward/return conductor pairs.

The invention also allows a specialized embodiment of the conductor arrangement, said embodiment being optimized for the section concerned. In this case, a first section (from the oscillator to the branch point) can be implemented in the form of e.g. HF litzendraht conductors featuring particularly low loss, where there is likely to be less demand for temperature stability. A second section is formed by the individual insulated conductors acting as inductors. In this case, consideration must be given to increased mechanical demands on the installation and increased thermal demands during operation, while slight ohmic conductor losses are less important. A third section is formed by the electrode, a non-insulated conductor end which, due to its length and e.g. by virtue of surrounding salt water, has low contact resistance relative to the reservoir. Such measures (saline injected regions at non-insulated tips) are known and therefore provide a low-resistance grounding.

In order to prevent the cumulation of the inductive voltage drop along the whole conductor length, a compensated conductor comprising a resonant conductor system and a series resonance circuit, as described in the aforementioned earlier patent applications, are advantageously used here.

The use of compensated conductors is essential in that section of the inductor lines which is guided in the reservoir, due to its length and the generally large distance (>5 m) between the inductors. It is sometimes possible to dispense with compensated conductors in the sections I and III, if the sections are short (<20 m) or if the distance between forward and return conductors is very small (<0.5 m). A very small distance and an associated low inductance per unit length of the line section occur in particular in the case of stranded or coaxial forward and return conductors.

2. Power generators are required for the invention. Static converters, as described in detail in the above cited German patent application DE 10 2007 008 292, are a favorable embodiment of power generators in the frequency range concerned. In addition to the power at the basic frequency (switching frequency), static converters supply significant portions of higher harmonic components, i.e. power at whole-number multiples of the basic frequency. In the context of the present invention, in a specific development, it is proposed that a plurality of adjacent forward/return conductor pairs which are mainly resonant at the basic frequency, and some which are resonant at harmonic frequencies, be operated in parallel on a converter (or on a group of converters), such that the power of the converters is also utilized at the higher harmonic frequencies. Due to the immediate proximity of the feeding points, the multilateral boreholes are particularly suitable for this.

3. The assignment and construction of the inductor lines are important in the context of the invention. The individual compensated inductor consists of sectionally repeating and capacitively coupled conductor groups, whose inductance per unit length, capacitance per unit length, and length determine the resonance frequency. In the present context, conductor cross-section configurations are proposed whose current density distributions on both conductors are rotationally symmetrical or approximately rotationally symmetrical to the inductor axis. This is already disclosed in the earlier, non-prior published patent application of the applicant DE 10 2008 012895.

4. The two inductors, which are grounded at their ends, can alternatively diverge in differing directions, e.g. in opposing directions. It is further proposed that the inductor arrangement be continued periodically in an x direction and/or periodically in a y direction. In a specific development of the invention, it is proposed that the current amplitudes and phase position of adjacent generators be adjustable, an array of inductor lines and generators being suitable for this purpose.

5. The array of inductors as per point 4 is suitable for heating the reservoir over a large area. According to the invention, it is proposed that a plurality of injection and production pipes be arranged perpendicular to the orientation of (and underneath) the inductors. Consequently, the inductors do not have to run parallel with the production and injection pipes, as generally described previously, but at an angle that is directed specifically perpendicular to the production pipe, i.e. in a transverse direction. This allows a variation of the heat output along the production pipes and in particular an early extraction start, since the distance between inductors and production pipes is very small at the crossover points. The perpendicular orientation is merely the specific case here. The same advantages are also derived already using a smaller angle between inductors and production pipes.

6. If cooling of the inductors using e.g. salt water is not necessary, salt water can alternatively be introduced by means of perpendicular boreholes to the inductor ends (i.e. electrode sections) that are to be grounded. Cooling medium and electrolyte (salt water) can also be different liquids. The cooling medium can circulate in the inductor (e.g. coaxial forward and return lines for the cooling medium), and can be circulated in a closed cooling circuit comprising a heat exchanger. Concerning this, reference is again made to the earlier application DE 10 2007 008 292.

7. The injection of salt water for improved grounding of a row of an inductor array as per point 6 can alternatively be done by means of a pipe which is locally slotted, and which is introduced through a horizontal borehole and oriented perpendicularly to the inductors, for a plurality of inductors jointly.

Alternatively, the scope of the invention also provides for the electrode sections to be guided into water bearing layers outside of the reservoir (above or underneath), in order to provide a good electrically conductive connection to the surrounding earth, this being possible at little technical expense. Water bearing layers are often contained in the overburden and/or underburden.

In an inventive development, it is also proposed that the distance between forward and return conductors of a capacitively compensated inductor be varied sectionally within the reservoir. The distance variation causes sectionally differing inductances per unit length of the dual line. It is proposed to equalize the variation in the inductance per unit length by means of adapted resonance lengths and/or by means of adapted capacitances per unit length (e.g. using different dielectric thicknesses) in the case of constant resonance lengths. The variation in inductance per unit length can also be equalized by a combination of changing the capacitance per unit length and adapting the resonance lengths.

The laying of distance-optimized inductors in the reservoir can now be adapted to the geological conditions in the reservoir, already at the start of extraction. If applicable, this can be done as an upgrade to existing pairs of production and steam injection pipes which are already being used for extraction.

The laying of a distance-optimized inductor can also take place in addition to already existing inductors. In this case, it is possible to effect an electrical interconnection with forward or return lines of inductors that were laid previously, wherein the operation can be coordinated in the case of series resonance by means of frequency adaptation at the generator/converter. The distance variation can be effected in a vertical and/or horizontal direction, whereby the heat output distribution can be adapted to the reservoir geometry.

The latter inventive development advantageously provides homogenization of the heat output along the inductors for sectionally differing electrical conductivities by virtue of distance adaptation. In this case, inductors can be laid in such a way that large steam chambers are avoided horizontally and/or vertically.

As a result of the specified inventive development, it is possible to avoid penetration of the steam chamber, which is often formed at the beginning of the injection pipe, by means of an inductor that is moved forwards and/or runs downwards at an obtuse angle greater than 90°. If applicable, the oscillator can be installed in the end region of the injection and production pipe pair in this case.

The novel installation has significant advantages vis-a-vis the installations and/or apparatuses previously disclosed in the prior art and vis-á-vis those previously described in the earlier, non-prior published patent applications. Specifically, these are:

1: The magnetic fields of the forward and return conductors, which are guided at a close distance and are subjected to opposing currents, compensate for each other almost completely, such that already in the immediate vicinity of the capping (overburden) only small eddy currents are induced and therefore the power loss is drastically reduced. In this case, the coaxial embodiment of forward and return conductors is ideal with regard to power loss, but involves greater expense at the branch point. Using the coaxial arrangement, the environment is completely field-free. In particular, this additionally allows the use of electrically conductive and magnetic materials (steel) for jacketing the forward/return conductor pair, or for lining the borehole with steel pipes in the section of the conductor pair. A borehole is also economized. In addition to this, the emission of electromagnetic waves is significantly reduced and the screening of the oscillator at the feeding point becomes more compact and/or simpler, thereby decreasing the extent of the exposure area from which operating personnel are excluded.

2: There is a significant saving in boreholes while preserving the advantage specified under point 1. The drilling technique required for this purpose has developed in the meanwhile and is known as 'multi-lateral drilling'. Moreover, due to the physical proximity, one oscillator can operate with various inductors alternately, or a plurality of oscillators can be interconnected to one inductor, e.g. during the pre-heating phase. The screening expense in turn is reduced if a plurality of oscillators can be operated in a single screening cabin.

3: The grounding of the conductor ends results in the electrical closure of the conductor loop, without any need for direct electrical connection of the conductor ends. The conductor configuration therefore requires no special drilling techniques, but can be managed using the existing standard drilling techniques. The insulated inductor section holds the current in the conductor and prevents premature short-circuiting via the reservoir, thereby allowing uniform loss distribution along the inductor. The loss distribution, which is calculable by means of 3D EM simulation, can be represented in the plane at the depth of the inductor. In a specific example (10 kHz, 707 A rms), the losses into the earth are distributed as follows: 0.3% for the forward/return conductor pair (section A), 96.5% for the inductor (section B) and 3.2% around the conductor ends (section C).

4: Wavelength effects are therefore avoided, which would otherwise result in current variations along the conductor and hence in corresponding variation of the power loss density.

5: The power in the higher harmonic components of the converter generators can be used for reservoir heating. These would otherwise accumulate as losses in the converter and could even destroy it.

6: In the event that there is no current density within a certain radius around the inductor axis, the rotationally symmetrical current distribution provides a field-free inductor core which can be used for transporting the salt water or mechanically amplifying the inductor by means of e.g. a steel rope, without eddy current losses occurring in the salt water or steel rope, i.e. without additional warming of the inductor.

7: In the case of diverging inductors, as in the case of continuation in the x direction with injection and production pipes running parallel, the inductor length need only be a fraction of the length of the pipes, this being advantageous in the context of manufacture, installation (maximum insertion length is dependent on stiffness of the inductor and is possibly less than that of pipes) and operation (reduction in the voltage requirements at the generators and reduction in the pressure requirements for the salt water injection). Due to the possibility of adjusting the phase position of the generators relative to each other, the return currents through the reservoir and hence the power loss density distribution in the reservoir can be controlled.

8: The electrical fields that are induced by the inductors run parallel therewith and hence, in the proposed orientation, perpendicular to the injection and production pipes. It is therefore possible to a large extent to achieve an inductive separation of inductors and pipes, thereby preventing or at least significantly reducing voltages on the pipes, eddy current heating in the immediate environment of the pipes, and any influence on or interference with electrical equipment (such as sensors) in/at the pipes.

9: The manufacture and operational reliability of the inductors are simplified if apparatus for carrying salt water is not required. At the same time, the number of additional (perpendicular) boreholes required for injecting the salt water decreases if the electrode sections are guided closely together.

10: The preferred combination of electrical forward and return conductors and their introduction into a single borehole saves significant drilling costs in practice.

A sectionally adapted heat output strength can be generated. In the predominantly vertical sections, forward conductor and return conductor are guided closely together. This makes it possible to achieve very low inductive heat output levels in the surrounding capping layer (overburden) of e.g. only 2.5 W/m (FIG. 5: Table row 1, Distance 0.25 m), which is desirable since heating of the capping layer is not intended. In the sections 2 to 7, the forward and return conductors are guided at varying distances, thereby allowing the heat output strength to be adapted to the relevant section. The greater the distance between them, the higher the heat output per length. The table (FIG. 5) lists heat output levels that are produced in a typical reservoir for different distances between forward conductor and return conductor when a current of 825 A (peak) @ 20 kHz is applied. Current drilling techniques allow the distances to be reduced to 5 m, thereby allowing the heat output in the respective reservoir to be varied by a factor of 80 (111 W/m at 5 m distance, 8874 W/m at 100 m distance) using an identical applied current in the sections, this being necessary due to the connection in series. It is therefore possible to introduce a heat output which is sectionally adapted to geological and extraction conditions within the reservoir.

The table below specifies the inductances per unit length of a dual line comprising forward and return conductors of the inductor. These vary depending on the distance. In this case, the influence of different reservoir conductivities is very slight. The inductor as a whole represents a series connection of series resonance circuits. A series circuit is formed by the line section with the resonance length. Ideally, all series circuits are resonant at the same frequency. This results in the smallest possible voltages along the inductor. Using inductors of constant resonance length, sectionally varied distances result in sectionally incomplete compensation, resulting in greater demands in terms of the dielectric strength of the dielectric between filament groups, which can result in dielectric breakdown and destruction of the inductor in a worst case scenario. This can be solved by adapting the resonance length and hence the capacitance of this section to the inductance per unit length there.

According to the invention, the capacitance per unit length can advantageously be adapted with ease to the relevant inductance per unit length, and therefore the same resonance frequency can be set, again sectionally, without changing the resonance length. A combination of these measures can also be used sectionally to achieve the objective of minimal voltage demand.

If the geological conditions in the reservoir are well known, the inductor can be laid accordingly, using distances that are adapted sectionally to the required heat output. This can take place practically at the same time as the introduction of the steam injection and production pipes for SAGD, such that the inductive heating is already available for the pre-heating phase.

The following approach can also be advantageous: The SAGD process is initially applied for a number of months or years without EM support. The steam chambers are already constructed. Variations in the steam chamber extent along the steam injection and production pipes are generally undesirable, since they can result in a premature steam breakthrough in individual sections (steam breakthrough regions). If such a steam breakthrough occurs, it is possible under certain circumstances that the remaining bitumen in the other sections of the reservoir can no longer be economically extracted (steam to oil ratio (SOR)<3), and this can therefore involve significant financial losses. Such losses can be avoided if the inductive heating is used to regulate the steam chamber extent long before a steam breakthrough occurs. In addition to this, the distance-optimized laying of inductors can be adapted to the additional inductive heat output required for each section. The exploitation of existing SAGD fields can be coordinated using this upgrade solution.

In the specific exemplary embodiments and the associated figures below, the inductors are represented at the same depth within the reservoir and the distance variation is only effected in a horizontal direction. Forward and return conductors of an inductor can also be laid at differing depths if the consequential heat output distribution and/or the laying of the inductor lines are more advantageous thus, e.g. due to reduced drilling costs that may be produced as a result of softer rock formations or other geological outline conditions.

If differing electrical conductivities are present in sections of the reservoir, the heat output density can be homogenized by adapting the inductor distance. An example for this is given in the table. If 4 kW/m is required to be introduced in a reservoir section having a specific resistance of 555 Ohm*m, the inductor distance must be 50 m in this exemplary geometry. If the electrical conductivity in another section of the reservoir is only half of this amount, the inductor distance must be increased to 67 m in order to introduce 4 kW/m heat output again.

In certain sections, forward and return conductors are advantageously guided in close proximity to each other if only low heat output densities are required there. Forward and return conductors could therefore run through the steam chamber and be exposed to the high temperatures there (e.g. 200° C.), which could result in premature aging of the inductor and hence a reduction in the service life. This can be avoided if the region of the steam chamber is bypassed horizontally and/or vertically as shown in section VI.

Using the SAGD method, the steam chamber often grows more quickly at the start of the horizontal section than in the sections lying further forward, since the steam temperature is hottest close to the discharge point and the steam pressure is highest there. This often results in the formation of a large steam chamber. It can therefore be beneficial to forgo additional inductive heating there, also in order to avoid premature steam breakthroughs. The oscillator can be moved forwards for this purpose, such that the inductor does not have to pass through the steam chamber at the start.

The same can be achieved if the inductor is guided downwards at an obtuse angle, if the oscillator still has to be installed close to the injection and production pipes. It is advantageous that inductor length and hence associated drilling costs can be saved. The premature aging of the inductor in the region of the first steam chamber is also avoided.

The invention allows inductor arrangements in which the loop is closed underground, this being possible using highly developed drilling techniques. In this case, the oscillator can be installed in the end region of the pipe pair as illustrated, or in the vicinity of the start of the pipe pairs (well heads) as in the previous figures. Inductor length and hence costs are saved by the conductor loop which is closed underground and leaves a space for the steam chamber.

BRIEF DESCRIPTION OF THE DRAWINGS

Further details and advantages of the invention are revealed in the following description of the figures relating to exemplary embodiments, with reference to the drawing in conjunction with the patent claims.

In the form of schematic and to some extent perspective illustrations.

Identical elements in the individual figures have identical or corresponding reference signs. The figures are described jointly in some cases.

DETAILED DESCRIPTION OF INVENTION

In the three-dimensional illustrations of a layer featuring an oil reservoir, i.e. in the FIGS. 1 to 3, 6, 9 and 10, 100 in each case signifies an elementary unit of the reservoir, which is considered in each case for the individual descriptions of the further figures. Such an elementary unit can be repeated any number of times in both horizontal directions of the layer.

Figure 1:
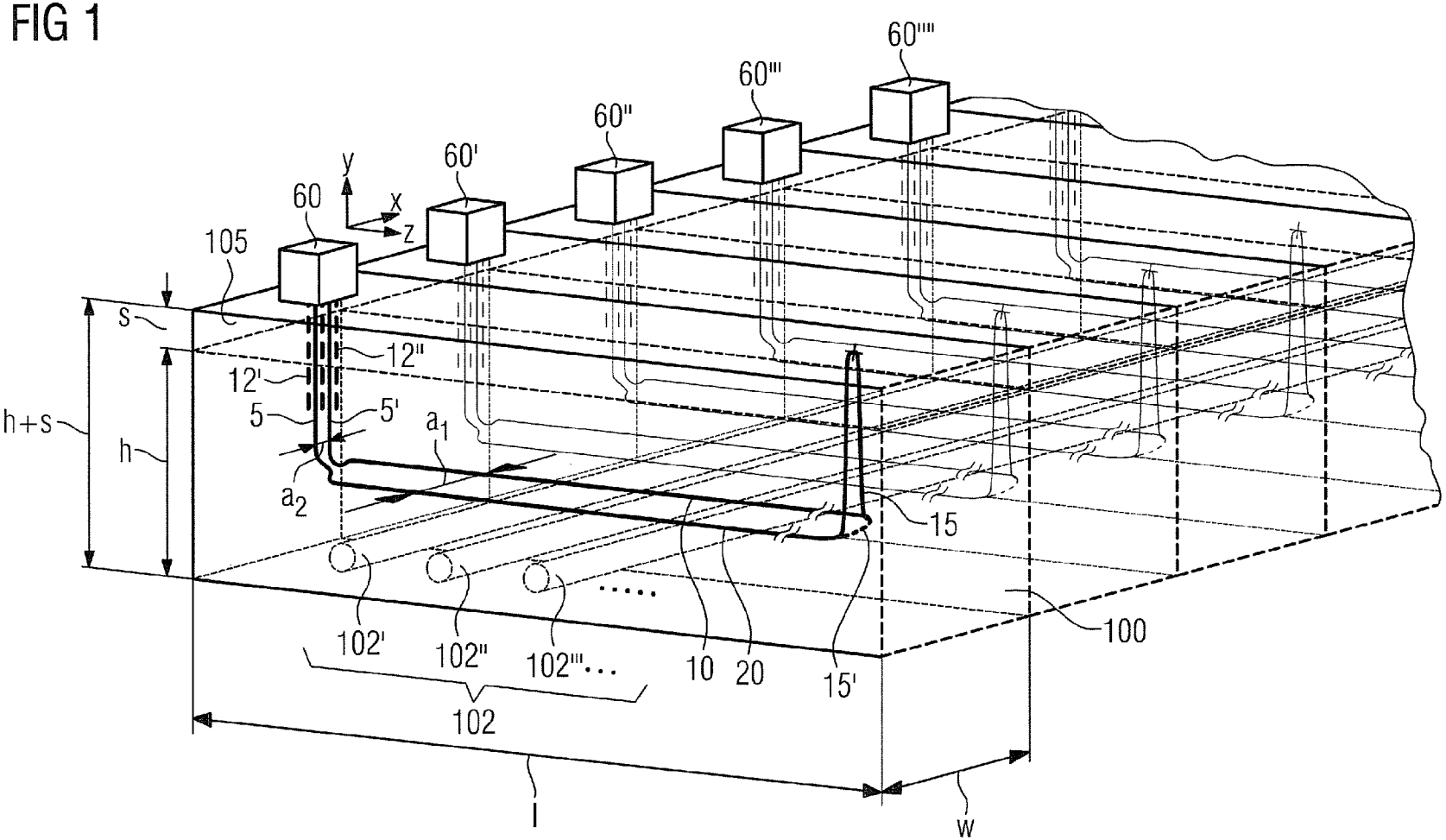
FIG. 1 shows an oil sand deposit comprising a plurality of elementary regions, featuring a plurality of conductor arrangements for inductive reservoir heating and an extraction pipe.

The latter is evident in FIG. 1, for example: An underground oil sand incidence (layer) forms the reservoir, wherein elementary units 100 having a length l, height h and width w are shown one behind the other or alongside each other. Above the reservoir 100 is a capping layer 105 (overburden) having a thickness s. Corresponding layers (underburden) are located below the reservoir 100, but are not individually identified in FIG. 1.

In the context of the known SAGD method, an injection pipe for introducing steam, by means of which the viscosity of the bitumen or extra-heavy oil is decreased, and an extraction pipe or production pipe are provided on the bed of the reservoir 100, said pipes being situated essentially one above the other. The production pipe is designated as 102 in FIG. 1, while an injection pipe is not illustrated here and is possibly also superfluous. The provision of lines and/or electrodes for electrical heating of the reservoir 100 has already been proposed. Specifically for the purpose of inductive heating, the lines are embodied as inductor lines 10, 20 in FIG. 1. The inductor lines 10, are guided in the reservoir 100 at the predefined distance $a_1$ in an essentially parallel and horizontal manner.

It is important in FIG. 1 that production pipe 102 and inductor lines 10, 20 do not run in the same direction, but in particular form a right angle. Other angles, i.e. orientations of inductor lines and production pipes, can also be used. It is thus possible to allow for the geological outline conditions.

The series of units 100 are each assigned an oscillator unit 60, 60', . . . as an HF power generator above ground, from which the electrical power is generated and fed into the inductors via forward and return conductors. For this, forward and return conductors must be guided perpendicularly through the capping into the reservoir. Provided the distance $a_2$ between forward conductor and return conductor in the vertical region is as small as possible and $a_1>a_2$, no heating occurs and energy is saved.

Two boreholes 12, 12' are present for this purpose in FIG. 1, having a distance of less than 10 m. This is small in comparison with the dimensions of the reservoir and in particular with the length of the inductor lines 10, 20. The forward conductor is guided in one borehole and the return conductor in the other borehole, wherein expansion to a multiple of this distance occurs at the transition to the inductor lines in the reservoir.

Instead of being guided in separate parallel boreholes, forward and return conductors can also be guided in a single borehole, thereby resulting in the possibility of an even smaller distance. In a single borehole, the forward and return conductors can be stranded together or even form a coaxial cable which splits in the reservoir.

A system of coordinates comprising the coordinates x, y and z is marked in each of the FIGS. 1, 2, and 6 to 8, thus facilitating orientation in the mine. The system of coordinates can also have a different orientation.

Figure 2:
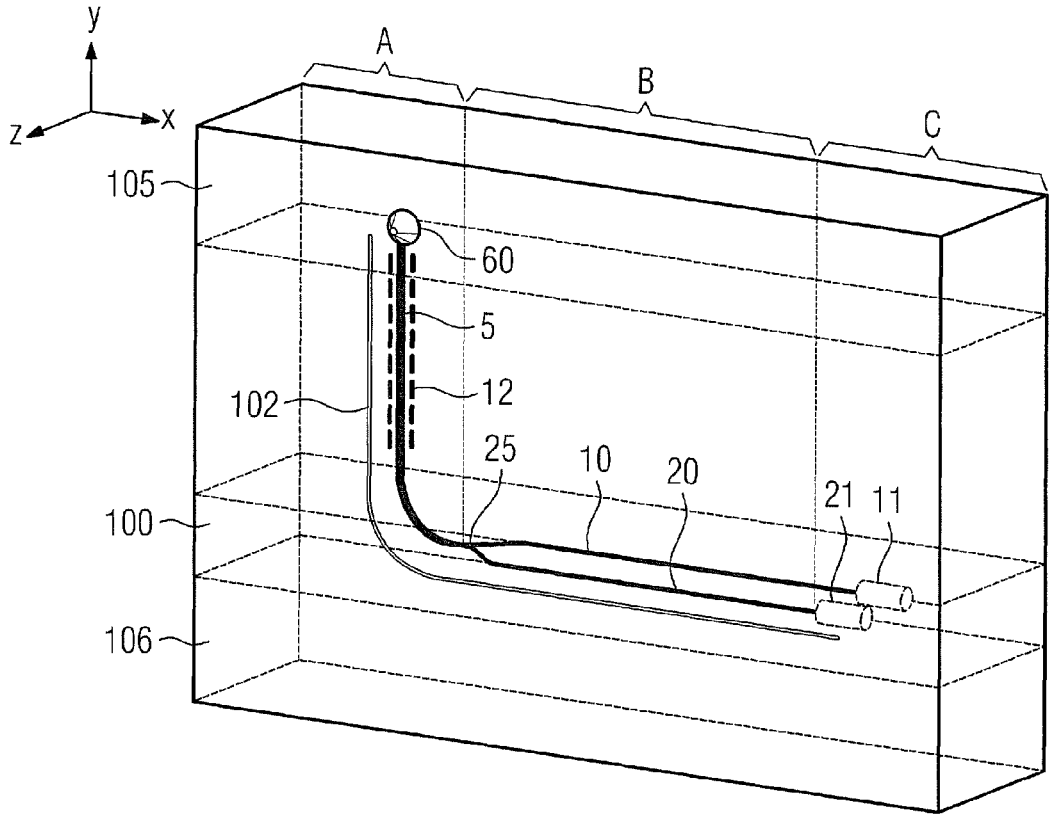
FIG. 2 shows a conductor arrangement for inductive reservoir heating and grounded inductors.

FIG. 2 specifically illustrates that underneath the soil comes first a region 105 including capping, then a deposit comprising a reservoir 100 of bitumen and/or extra-heavy oil, and then a region 106 (basement) that is impermeable to oil. Such ground formations or rock formations are typical for oil shale or oil sand deposits.

As per FIG. 2, electrical energy is introduced into the deposit 100 from an oscillator 60 as a high-frequency generator which is situated above ground. In order to achieve this, provision is made here for a single vertical borehole 12, which runs as far as the region of the reservoir 100, where it converts into two horizontal boreholes (not shown in detail). From outside of the capping, means are also provided for introducing salt dissolved in water (saline), this having suitable conductivity characteristics.

A conductor pair comprising a combined electrical forward and return conductor 5 is introduced into the vertical borehole 12, wherein the terminal ends of forward and return conductors are connected to the oscillator 60 as an energy converter. The other ends run as far as the reservoir 100.

The forward/return conductor pair 5 splits when it reaches the reservoir 100. A so-called Y branch point 25 is provided for this purpose. Starting from the Y branch point 25, the inductor lines 10 and 20 run in the reservoir 100 horizontally and in parallel with each other within the reservoir 100 and as far as the salt-injected region, in which the lines 10 and 20 are not insulated and act as electrical inductors. The induction heating is therefore intended to develop in the region of the inductor lines 10, 20 in particular.

Using such an installation, the power loss is considerably reduced because the magnetic fields of the forward and return conductors, which are guided at a close distance and subjected to opposing currents, compensate for each other almost completely in the region A. The grouped forward and return conductor pair can be constructed as a coaxial line 5, for example. The environment of such a conductor pair is completely field-free as a result of the coaxial arrangement, in particular. This allows the use of electrically conductive and magnetic materials for jacketing the forward/return conductor pair, or steel pipes for lining the vertical borehole 12.

The Y branch point 25 is constructed in a manner which is known in terms of electrical engineering, and is not discussed in greater detail in the present context.

Since the emission of electromagnetic waves is significantly reduced in the region of the perpendicular borehole 12, the screening of the oscillator 60 at the feeding point can be more compact in its construction. This is advantageous for the so-called exposure area, from which operating personnel are excluded.

The actual production pipe is identified as 102 in the figures. It is usually constructed in accordance with the prior art, in such a way that liquefied bitumen collects therein and can subsequently be removed by suction in a known manner.

As shown in FIG. 2, an approximately cylindrical and saline region 11/21, which is particularly important for the electrical conductivity and hence the inductive heating effect, is produced in each case at the end of the two conductors 10 and 20. This achieves the effect of a low-resistance grounding of the inductors, without these having to be connected together via a separate conductor loop underground or above ground.

Therefore a total of three regions are formed in FIG. 2:

The lines 10/20 from the oscillator 60 as far as the branch point 25 form a first section A, in the reservoir 100 a second section B, and in the end region a third section C. Different conductor arrangements can advantageously be selected in the individual sections A, B and C. Litzendraht conductors are used in the first section A, for example. However, active insulated conductors (insulated single conductors) are used for the inductor lines in the second section B, while non-insulated conductor ends fanning electrodes are provided in the third section C.

Figure 3:
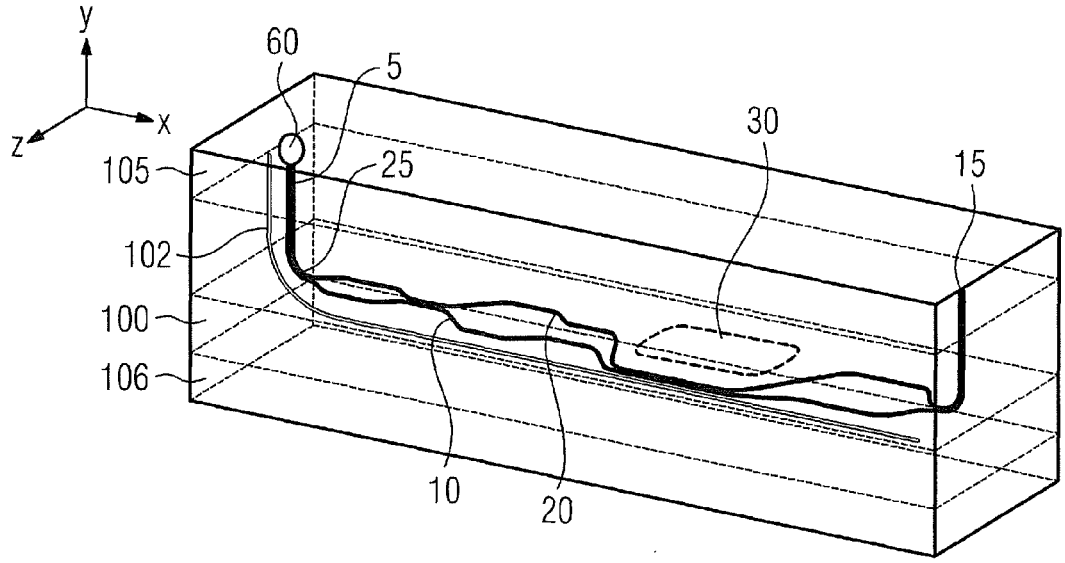
FIG. 3 shows an arrangement as per FIG. 2 featuring sectionally varying distances between the inductor lines.

As shown in FIG. 3, using an arrangement as per FIG. 1, guided induction lines 10 and 20 need not run in parallel in this case. Instead, they have sectionally differing distances and this can be adapted to the conditions of the deposit. Depending on the geological conditions, they can have some sections for inductive interaction, and be very close together there, such that their fields compensate for each other. In particular, if a gas pocket 30 exists in the deposit 100 due to the steam injection by means of the SAGD method, wherein said pocket forms a so-called "dead" region and/or has been already exploited, the parallel arrangement of the lines 10/20 can be guided carefully around this gas pocket region and separate behind the steam pocket 30 again in order to generate the inductive heat effect. A conductor loop is again formed at the end, in a known manner, and is closed above ground in particular, this being easy to achieve in manufacturing terms.

Figure 4:
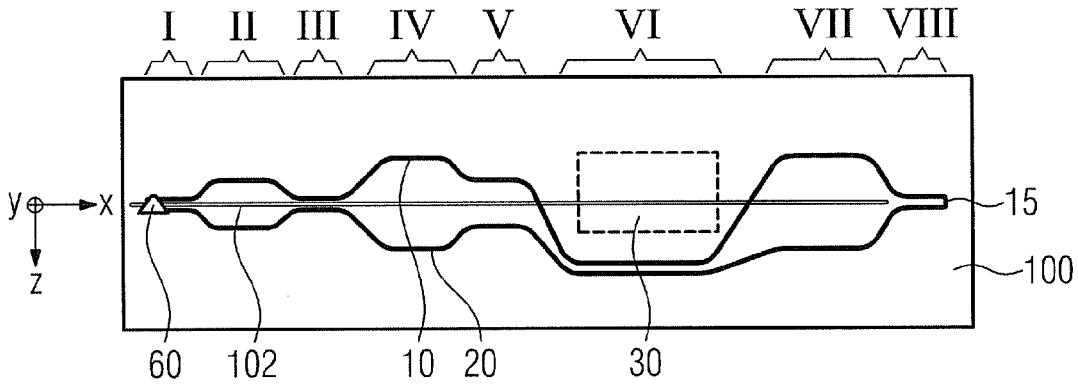
FIG. 4 shows the top view of an inductor arrangement as per FIG. 3, with eight sections having differing conductor distances.

A corresponding top view of such an inductor arrangement is shown in FIG. 4. In total, eight sections I, II, . . . , VIII are marked and have differing distances $a_i$ between the inductor lines 10/20. It should be noted that individual compensation measures for the lines are carried out separately in each case for the sections I, II, . . . , VIII on the basis of the changed resonance lengths.

The following table specifies the inductances per unit length of a dual line, i.e. forward and return conductors of the inductor. As mentioned above, these vary between approximately 0.46 and 1.61 μH/m depending on the distance $a_i$. The influence of different reservoir conductivities is very slight in this case. The inductor as a whole represents a series connection of series resonance circuits.

A series circuit is formed by the line section having the resonance length $L_R$. Therefore all series circuits would ideally be resonant at the same frequency. This would result in the lowest possible voltages along the inductor. Using inductors of constant resonance length, however, sectionally varying distances result in sectionally incomplete compensation, resulting in greater demands in terms of the dielectric strength of the dielectric between filament groups. In some circumstances, dielectric breakdown or even destruction of the inductor can also occur.

This can be solved by adapting the resonance length in the individual sections, and hence the capacitance of this section, to the inductance per unit length there.

TABLE

| Distance between conductors [m] | Reservoir resistance [Ωm] | Heat output rate [W/m] | Inductance (analytic) [μH/m] | Inductance (FEM) [μH/m] | Resonance length @ 20 kHz [m] |
|---|---|---|---|---|---|
| 0.25 | 555 | 2.5 | 0.456 | 0.456 | 37.1 |
| 5 | 555 | 111 | 1.055 | 1.055 | 24.4 |
| 10 | 555 | 356 | 1.194 | 1.193 | 22.9 |
| 15 | 555 | 688 | 1.275 | 1.273 | 22.2 |
| 50 | 555 | 4059 | 1.516 | 1.490 | 20.5 |
| 100 | 555 | 8874 | 1.564 | 1.569* | 20.0 |
| 100 | 2 * 555 | 6859 | 1.564 | 1.608* | 19.8 |
| 67 | 2 * 555 | 4067 | 1.574 | 1.552 | 20.1 |

In the table, column 1 shows the distance between the induction lines in m, column 2 shows the resistance of the reservoir in m, column 3 shows the injected electrical power in W/m, column 4 shows the inductance in μH/m (calculated analytically and using FEM), and column 6 shows the resonance length in m for an oscillator frequency of 20 kHz.

It can be seen that the heat output rate in the form of an electrical power loss rises as the distance between the inductor lines increases. Conversely, it follows that only a small power loss occurs if there is a comparatively small distance between the inductor lines because, in the case of lines that are closely adjacent to each other, the electromagnetic fields largely compensate for each other and therefore no inductive heating effect occurs, as in the case of the vertically guided forward and return conductor pair 5. This effect can be exploited as required. The resonance length $L_R$ of the line likewise changes in this case, and must be adapted accordingly as shown in the earlier application DE 10 2007 008 292.

The table therefore lists the adapted resonance lengths for the respective distance between forward conductor and return conductor, in order to obtain the same resonance frequency per section, e.g. 20 kHz. The relative change in the resonance length is proportional to 1/sqrt (inductance per unit length). This means that the resonance length in the vertical sections which have an inductor distance of e.g. 0.25 m is approximately twice that for a nominal inductor distance of 100 m. Corresponding changes are produced for a resonance frequency of 100 kHz, for example. Specifically, resonance frequencies between 1 and 500 kHz are considered to be suitable, wherein both 10 kHz and 100 kHz were selected for the calculations.

As mentioned in the introduction, the compensation of the inductor lines is the subject matter of the earlier patent application DE 10 2007 008 292 and is already described in detail there, explicit reference to said earlier patent application being made here. In particular, so called multifilament conductors as per FIG. 5 can be used for this purpose, in respect of which reference is again made to the earlier patent application DE 10 2007 036 832.

Figure 5:
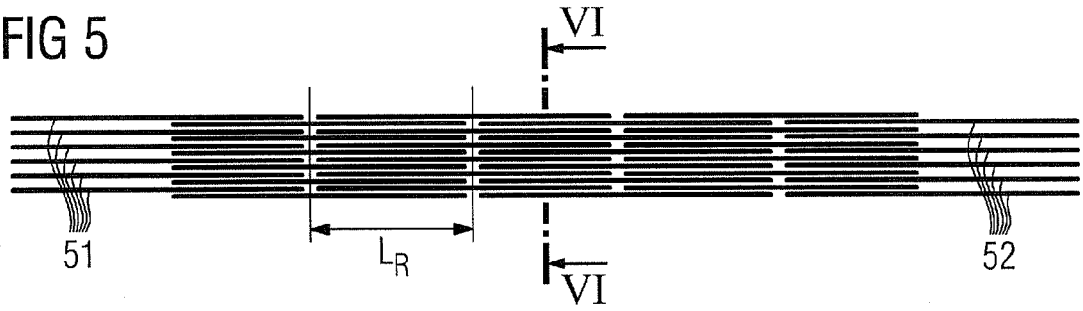
FIG. 5 shows the schematic structure of a compensated inductor featuring distributed capacitances.
Figure 6:
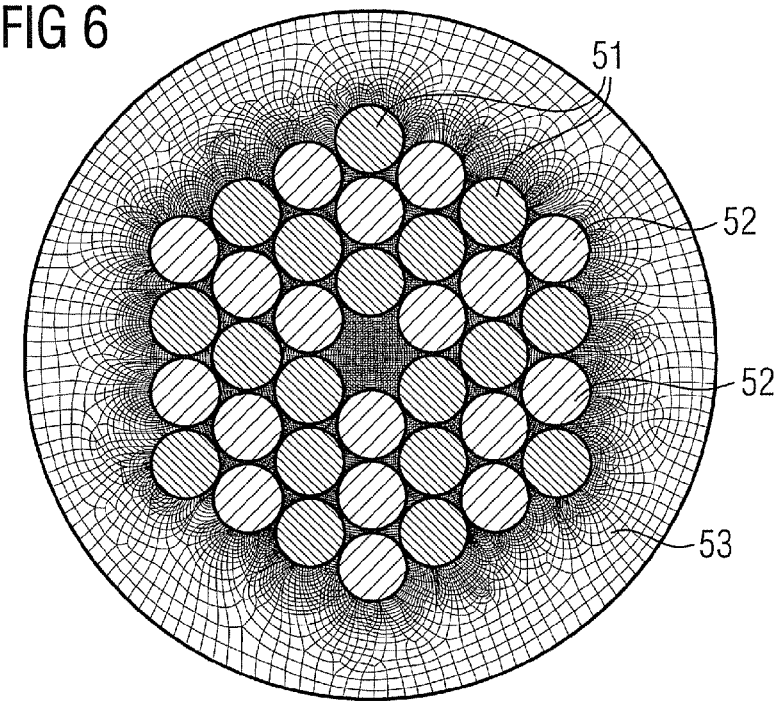
FIG. 6 shows the cross section of a multifilament conductor comprising two filament groups.

In this context, reference is made to FIG. 5: FIG. 5 shows the schematic structure of the compensated conductor for the inductor lines featuring distributed capacitances, and FIG. 6 shows the cross section along the line VI-VI. The lines are fruited from conductors 51 and 52, which form multifilament lines within an insulation 53 as shown in FIG. 6. In this case, the resonance length $L_R$ can be adapted to the sectionally varying distance between the inductor lines.

Figure 7:
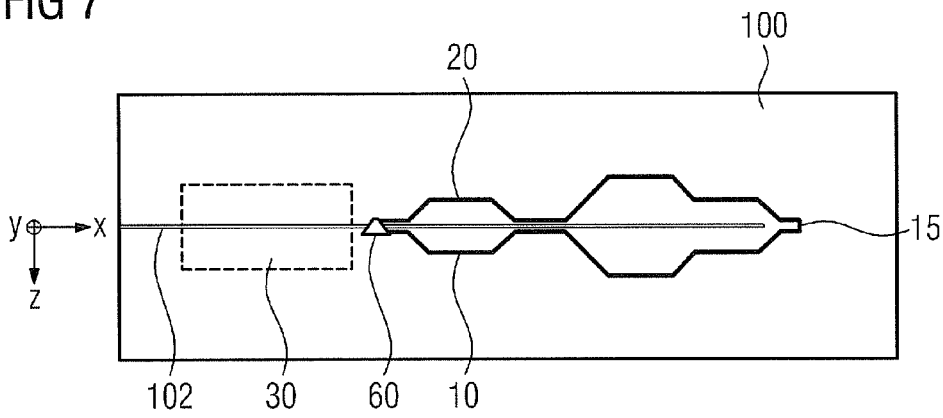
FIG. 7 shows a top view of an arrangement comprising a large steam chamber at the start section of the injection pipe and an oscillator position which is moved away therefrom.

FIG. 7 shows that, in the context of an arrangement as per FIG. 2, there might be a particularly large steam chamber 30 at the starting section of the injection pipe. In this case, it is recommended to move the position of the oscillator, i.e. the generator 60, above ground or even to arrange it in the end region of the conductor pair 10/20. In this case, the lines are closed by an underground conductor loop 15, which can also be arranged directly behind the steam pocket.

Figure 8:
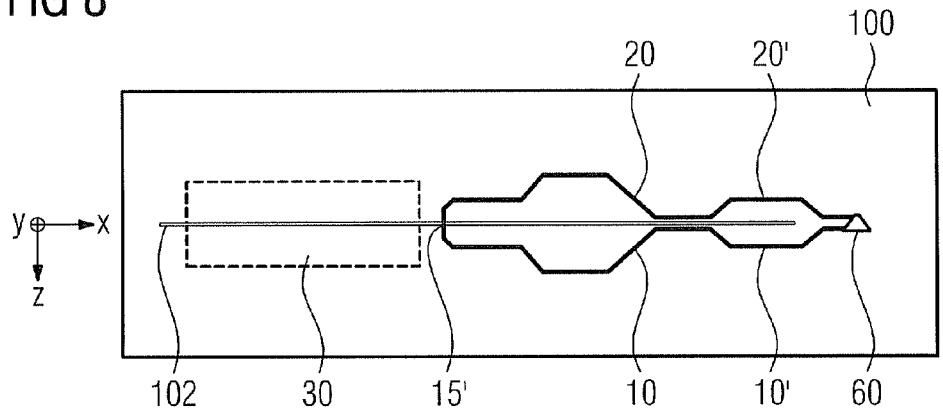
FIG. 8 shows a modified top view as per FIG. 7, featuring an oscillator position at the end region of the pipe pair and a conductor loop which is closed underground.

Corresponding layouts are illustrated as a top view in FIGS. 7 and 8. In particular, it is clear from these two figures that the inventive concept is also suitable for upgrading existing extraction installations for bitumen or extra-heavy oil. In practice, specific regions of oil sand deposits might have already been exploited using the known SAGD method, wherein large steam pockets usually form in the previously exploited regions. By means of an apparatus comprising a "mobile" high-frequency generator 60, the inductor arrangement can be moved from the starting section of the injection/extraction pipe apparatus and shifted forwards. It is equally possible to assign the oscillator position to the end region of the pipe pair. In this case, the inductor conductor loop is advantageously always closed underground.

Figure 9:
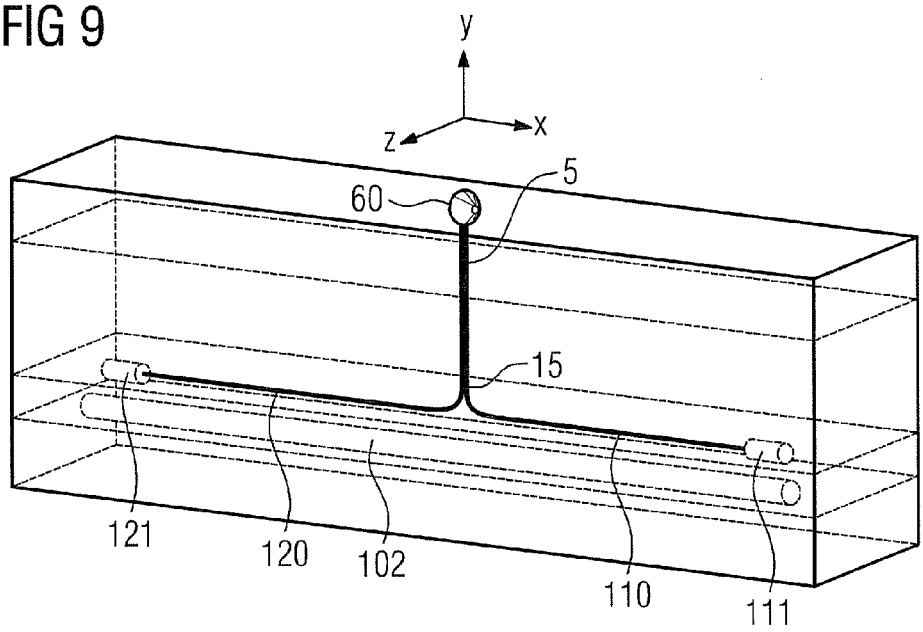
FIG. 9 shows an arrangement for inductive reservoir heating featuring grounded inductors which run in opposing directions.

FIG. 9 shows an arrangement in which, as per FIG. 1, a vertical borehole 12 is provided approximately in the center of the illustrated reservoir 100. A conductor pair 5 is again introduced into the vertical borehole 12 at the location of an oscillator 60. When the deposit 100 is reached, provision is now made for a type of branch point 25 from which the horizontal conductors 110, 120 run in diametrically opposing directions (i.e. separated by an increasing distance) and are finally grounded in each case by electrodes 111 and 121.

The associated distribution of the heat output in the context of this geometry was also calculated for this case by means of FEM (finite element method) and produced satisfactory outline conditions.

When the inductor lines are laid in this way, it is also possible to guide the non-insulated conductor ends out of the reservoir and into regions of greater electrical conductivity. Water bearing layers outside of the reservoir (e.g. in the overburden or underburden) may be available for this purpose, for example.

Figure 10:
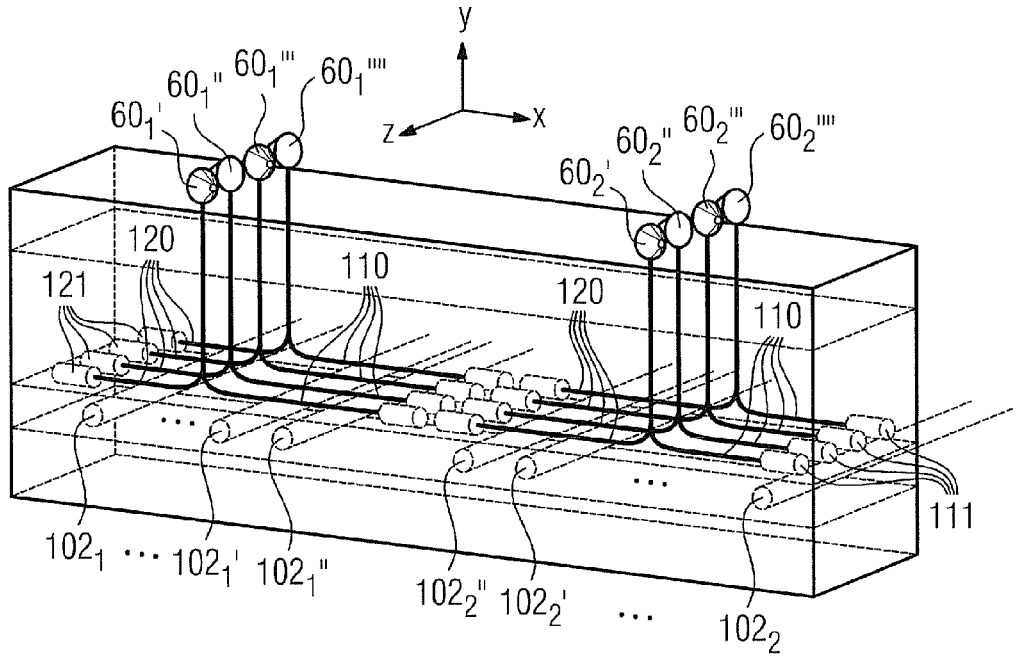
FIG. 10 shows part of a two-dimensional inductor/oscillator array comprising electrode sections which are guided together sectionally for the purpose of grounding.

Lastly, FIG. 10 shows a modification of an installation as per FIG. 1 with arrangements as per FIG. 9, in which a two-dimensional 200 is formed from individual inductors. The inductors are shown in the form of lines which run in opposing directions, and are shown one behind the other and in two adjacent rows. Above the deposit 100 in this case are two completely corresponding rows of oscillators 60, 60', 60", . . . , from which respective conductor pairs 5, 5', 5", . . . run perpendicularly through the capping to the deposit 100 and branch into opposing directions via corresponding rows of branch points 25, 25', 25", . . . .

By connecting such arrangements back to back, it is possible to minimize the power loss and therefore to optimize the heat output that is converted.

Particular to the two-dimensional array shown in FIG. 10 is that it consists of a multiplicity of antennas, which are formed in FIG. 10 specifically from the individual inductor pairs $\mathbf{110}_{ij}/\mathbf{120}_{ij}$, wherein these can be individually activated according to current amplitude and phase. For this purpose, each inductor pair is assigned a dedicated generator from the group of generators $\mathbf{60}_{ij}$ which is illustrated in FIG. 10 and distributed in the form of an array.

In summary, the invention states that the forward and return conductors of the inductor lines in the capping are now guided down in an essentially vertical manner to the depth of the deposit and, in comparison with the linear extent of the lines, have a small lateral distance a of maximally 10 m, and less than 5 m in particular. The inductor lines are preferably guided horizontally in the deposit and have sectionally differing distances, whereby the output distribution can be varied. If the electrical forward and return conductors running perpendicularly in the capping are grouped together to form a line pair, said line pair can be introduced into a single borehole which extends down as far as the reservoir, wherein said line pair does not split until it reaches the reservoir. No power losses then occur in the capping.

The invention claimed is:

1. An installation for the in-situ extraction of a substance comprising hydrocarbons from an underground reservoir, the installation comprising:

a production pipeline leading out of the reservoir, through which the hydrocarbons are extracted; and a means for induction heating assigned to the production pipeline for heating of the production pipeline environment, comprising:

an electrical high-power generator outside of a capping and deposit, an electrical forward and return conductor, and a plurality of induction lines which are connected to the forward and return conductor, wherein the forward and return conductor are guided essentially vertically in the capping to a depth of the deposit and in comparison with a linear extent of the plurality of induction lines include a small lateral distance between them of maximally 10 m, and wherein the plurality of inductor lines run horizontally in the reservoir and include a predefined distance between the plurality of inductor lines which vary in the horizontal direction depending on geological conditions in the reservoir, wherein a first section is formed from an oscillator to the reservoir, a second section in the reservoir is formed wherein the plurality of inductor lines run horizontally and generally along side each other within the reservoir and as far as a salt injected region, and a third section comprising the salt-injected region within the reservoir is formed in an end region, wherein a different structure of the conductor is selected in each case in the individual sections, wherein in the first section, the forward and return conductor is a stranded or coaxial design, in the second section, individual insulated conductors are used for the plurality of inductor lines, and in the third section, non-insulated conductor ends are provided forming a plurality of electrodes in the salt-injected region.

2. The installation as claimed in claim 1, wherein the forward and return conductors for two inductor lines are guided in parallel boreholes including a maximum distance between them of 10 m.

3. The installation as claimed in claim 2, wherein the forward and return conductors for the two inductor lines are guided as capacitively compensated lines in the parallel boreholes.

4. The installation as claimed in claim 1, wherein the forward and return conductors for the two inductor lines include a maximal lateral distance between them of 0.25 m and are guided in a shared borehole.

5. The installation as claimed in claim 4, wherein the shared borehole includes a diameter of <0.5 m, in which the forward and return conductors for the two inductor lines are guided at a close distance to each other.

6. The installation as claimed in claim 5, wherein the forward and return conductors for the two inductor lines are insulated against each other and form a combined line.

7. The installation as claimed in claim 6, wherein the combined line comprising forward and return conductors for the inductor lines is split in the reservoir.

8. The installation as claimed in claim 7, wherein a branch point in the form of a Y is provided at an end of the combined line.

9. The installation as claimed in claim 5, wherein reverse lay stranding or same lay stranding applies for forward and return conductors in the borehole.

10. The installation as claimed in claim 5, wherein forward and return conductors form a coaxial line in the borehole.

11. The installation as claimed in claim 1, wherein a plurality of conductor pairs comprising forward/return conductors for the plurality of inductor lines are guided in a single borehole.

12. The installation as claimed in claim 1, wherein litzendraht conductors are used for the forward and return conductor in the first section.

13. The installation as claimed in claim 1, wherein active insulated conductors are used for the plurality of inductor lines in the second section.

14. The installation as claimed in claim 1, wherein capacitively compensated conductors are used for the plurality of inductor lines in the second section.

15. The installation as claimed in claim 1, wherein the plurality of electrodes form an electrical loop in conjunction with salt enrichments.

16. The installation as claimed in claim 1, wherein the non-insulated conductor ends are guided from the reservoir into layers of greater electrical conductivity, wherein the layers of greater electrical conductivity are water bearing layers outside of the reservoir.

17. The installation as claimed in claim 1, wherein the substance comprising hydrocarbons is bitumen or extra-heavy oil and the underground reservoir is under a capping, and wherein the extraction reduces the viscosity of the substance.

* * * * *